US007582008B2

(12) United States Patent
Melotti

(10) Patent No.: US 7,582,008 B2
(45) Date of Patent: Sep. 1, 2009

(54) CENTRALIZED DEVICE FOR DISTRIBUTING AND DISCHARGING AIR INSTALLATIONS

(75) Inventor: Renzo Melotti, Sala Monferrato (IT)

(73) Assignee: Bobst Group Italia S.p.A., Piacenza (IT)

( * ) Notice: Subject to any disclaimer, the term of this patent is extended or adjusted under 35 U.S.C. 154(b) by 967 days.

(21) Appl. No.: 10/756,500

(22) Filed: Jan. 14, 2004

(65) Prior Publication Data

US 2004/0147218 A1 Jul. 29, 2004

(30) Foreign Application Priority Data

Jan. 17, 2003 (IT) ..... TO2003A0019

(51) Int. Cl.
*F24F 7/06* (2006.01)
*F24F 7/00* (2006.01)
*F26B 21/06* (2006.01)

(52) U.S. Cl. ..... 454/251; 454/237; 34/77; 34/78; 34/538; 34/649; 101/424.1

(58) Field of Classification Search ..... 454/236, 454/237, 239, 251; 34/77, 78, 538, 649; 101/480, 494, 424.1
See application file for complete search history.

(56) References Cited

U.S. PATENT DOCUMENTS 2,225,505 A * 12/1940 Offen ..... 34/465
2,554,239 A * 5/1951 Caulfield et al. ..... 34/649
3,237,314 A * 3/1966 Smith, Jr. ..... 34/266
4,125,948 A * 11/1978 Hering et al. ..... 34/655
4,150,495 A * 4/1979 Stern ..... 34/567
4,176,162 A * 11/1979 Stern ..... 423/245.3
4,233,901 A * 11/1980 Mallinson ..... 101/424.1
4,341,167 A * 7/1982 St. John ..... 110/235
4,343,096 A * 8/1982 Bergland ..... 34/538
4,502,228 A * 3/1985 Helbig et al. ..... 34/540
5,205,783 A * 4/1993 Dieckert et al. ..... 454/238

FOREIGN PATENT DOCUMENTS

JP 58147366 A * 9/1983

* cited by examiner

*Primary Examiner*—Steven B McAllister
*Assistant Examiner*—Patrick F. O'Reilly, III
(74) *Attorney, Agent, or Firm*—Young & Thompson

(57) ABSTRACT

A centralized device for the distribution and discharge of air causing the evaporation of a carrier in a number of user installations each having an intake channel and a discharge channel, comprising a single manifold for the reception, delivery and discharge of air-carrier mixture from and to the installations and a discharge fan connected to said manifold, and comprising for each installation: a device for air supply, connected to the single manifold and having a fresh air suction channel and an air supply channel, a fan connected to the air supply device, a heat exchanger connected to the fan and to the intake channel of the installation, a discharge device connected to the discharge channel of the installation and to the manifold and comprising a discharge channel, and a recirculation device comprising a recirculation channel connected to the air supply device and to the discharge device.

17 Claims, 1 Drawing Sheet

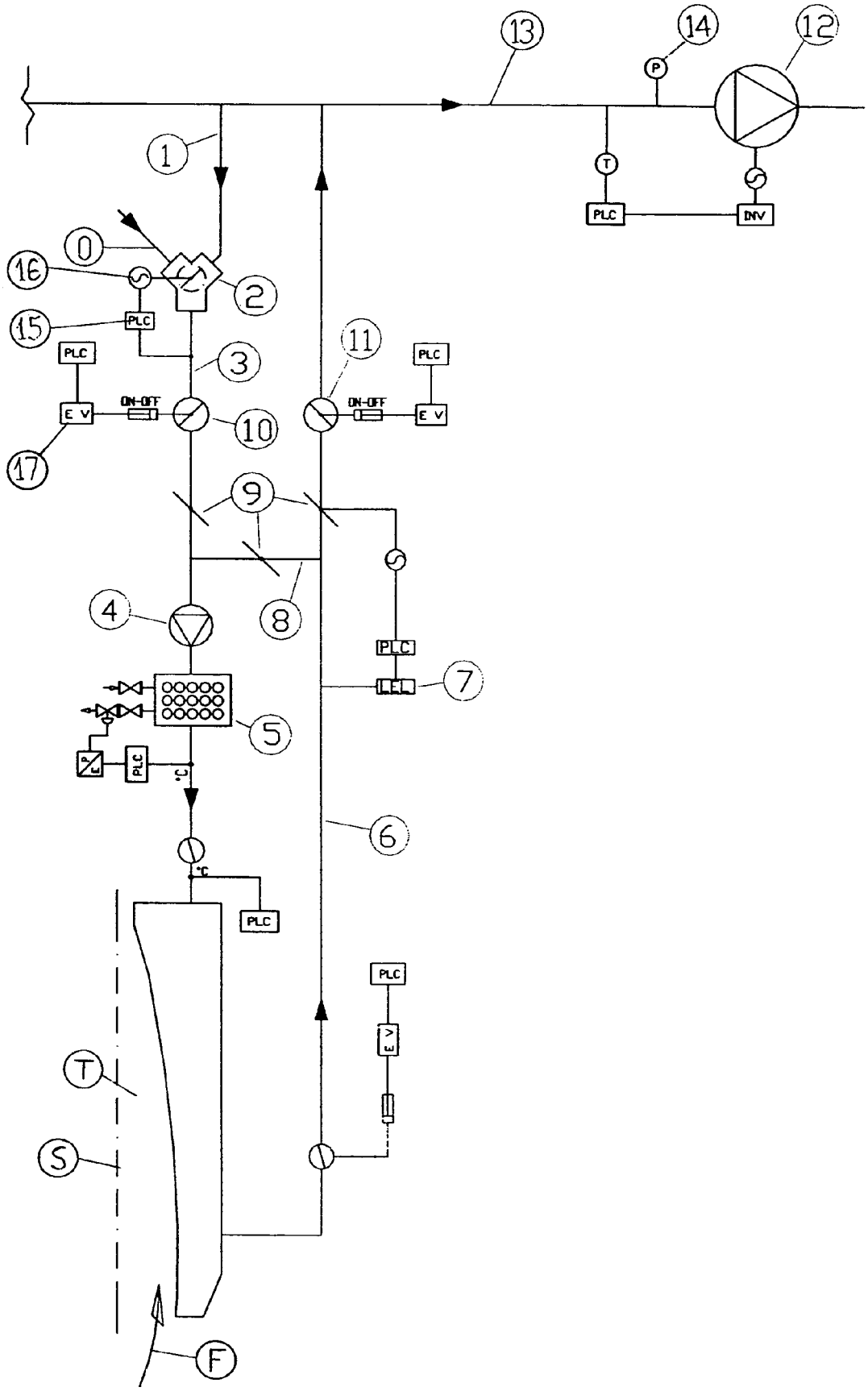
13
14
12
P
T
PLC
INV
1
0
16
2
15
PLC
3
11
PLC
PLC
ON-OFF
ON-OFF
E V
E V
10
17
9
8
4
PLC
7
5
PLC
°C
6
°C
PLC
PLC
T
S
F

CENTRALIZED DEVICE FOR DISTRIBUTING AND DISCHARGING AIR INSTALLATIONS

BACKGROUND OF THE INVENTION

This invention refers to a centralized device for the so called ventilation, namely, the distribution and discharge of air intended to cause the evaporation of a carrier in user installations, such as sections of rotogravure machines, transformation machines and the like.

This invention will be described with particular reference to rotogravure machines, which represent a typical application thereof, however this specific example of application has not to be regarded as a limitation for a more general application of the invention.

In the rotogravure machines, the different colors of a subject are printed sequentially on a support, by operating in subsequent sections of the machine, whose number may vary, for example, from three to ten and more. The ink or lacquer used for printing is diluted with a carrier, in most cases a solvent, whose purpose is that of conferring to the ink or lacquer a suitable viscosity and allowing to obtain the desired color tonality in the print. After print of each color, and before initiating the print of the subsequent color, this carrier should be removed by evaporation. In order to perform this operation, the printing machine comprises a number of evaporation tunnels, each tunnel being interposed between a pair of subsequent print sections. In each evaporation tunnel, an air stream is blown by means of special nozzles on the just printed face of the support, in order to cause the evaporation of the carrier, and the air-vapor mixture thus formed is discharged from the tunnel.

The delivery rate, velocity and temperature of the blown air should be suitably chosen in each tunnel, on one hand in order to ensure the complete evaporation of the carrier during the permanency period of the support in the tunnel, and on the other hand in order to obtain a suitable concentration of the vapor in the discharged air-vapor mixture.

In most cases, the carrier to be evaporated is a solvent forming with the air an inflammable mixture, which in certain cases is detonating too. It is therefore needed, for the sake of security, that the discharged mixture contains a vapor concentration lesser, according to a suitable security coefficient, than the lower detonation limit of the mixture. On the other hand, the regulations concerning the ambient protection against pollution do not permit to simply discharge in the atmosphere the mixtures of air and solvent discharged from the tunnel, and therefore these mixtures should be directed to purifying apparatuses for recuperating the solvent, or to removal apparatuses for its destruction, which usually is obtained by combustion. The management burden of these purifying apparatuses increases with the quantity of treated mixture, and is the more high the less is the concentration of the solvent in the mixture. As a consequence, it is important that, though respecting the security requirements, the concentration of solvent in the treated mixture has the higher possible value.

In order to satisfy these requirements, each tunnel is provided with its own air distribution circuit which is regulated, manually or by means of automatic devices, in such a way as to introduce, discharge and recycle suitable air quantities, selected as functions of the quality and quantity of solvent which has to be evaporated in the considered tunnel. The carrier quantities to be evaporated in the subsequent tunnels of the same rotogravure machine during the print of the same subject may be very different, due to the fact that the surfaces covered by the different colors of the printed subject may have extensions very different and, therefore, may give rise to quantities correspondingly different of carrier to be evaporated in the various sections. Therefore, also in view of the requirements of the various sections of the machine, which may be very different, the optimal conditions cannot be attained by a sole distribution circuit which operates all the tunnels without introducing differences among them.

As already said, the specific requirements stated for the rotogravure machines, or similar requirements, are encountered also in other installations, such as the transformation machines and others.

Presently, the rotogravure machines often use a device for air distribution, recirculation and discharge with respect to the printing elements, which is provided with an air supply channel, a fan, a discharge channel and, if needed, a heat exchanger, and this device is centralized for a number of elements (or, more generally, for a number of user installations). This device comprises a delivery manifold connected to the air supply channels of the various installations, a mixture suction manifold, connected to the discharge channels of the various installations, a discharge fan inserted in this mixture suction manifold, a channel for direction to the discharge, a fresh air suction channel, a valve system controlled for the regulation of the air streams, and a continual analyzer connected to the mixture suction manifold and intended to control the valve motors.

Thanks to these features the device, through its delivery manifold, supplies partially recycled air to a number of installations, and each installation uses the same by means of its own fan which is regulated according to the specific requirements of that installation, and if needed this air is heated by means of the own heat exchanger of the installation; then the air-solvent mixture discharged by the various installations is collected by the mixture suction manifold and mixed with the mixtures discharged by the other connected installations. The resulting mixture is analyzed in order to measure the carrier concentration, and three valves, present in the system, are operated by their motors under control of the analyzer in such a way as to direct to the discharge, by means of the discharge fan, a certain fraction of this mixture, to recycle another fraction of the mixture, by directing the same to the delivery manifold, and to add to the recycled mixture fraction a certain quantity of fresh air coming from the fresh air suction channel.

However, this system suffers certain limits. Particularly, its operation is scarcely effective in those cases in which two or more elements of the installation are charged to evaporate quantities of solvent very larger than the mean quantity evaporated in the other elements. In this case, the low values of recirculation allowable for that elements limit the recirculation directed to other elements which, on the contrary, in view of a low concentration of solvent at their discharge, could operate with a higher ratio of recirculation, thus taking advantage of the thermal recuperation and directing a lower air quantity to the discharge. These limits impose the use of an air distribution, recirculation and discharge system independent from the centralized system, for those elements in which prints or spreads are foreseen, which involve high quantities of solvent.

SUMMARY OF THE INVENTION

In view of the above, the main object of this invention is to improve a known centralized air distribution, recirculation and discharge system which serves a number of installations, in order to reduce to the minimum possible value the quantity of discharged air, and therefore the burden related to the solvent destruction or recuperation systems.

This object is attained, according to this invention, by a centralized air distribution, recirculation and discharge device intended to serve a number of user installations each having an intake channel and a discharge channel, comprising a single manifold for the reception, delivery and discharge of air-carrier mixture from and to the installations and a discharge fan connected to said manifold, said centralized device further comprising for each installation: a device for air supply, connected to said single manifold and having a fresh air suction channel, a fan connected to said air supply device, a heat exchanger connected to said fan, said intake channel of the installation being connected to said heat exchanger, a discharge device connected to said discharge channel of the installation and connected to said manifold, and a recirculation device connected to said air supply device and to said discharge device.

Preferably, each said air supply device for a user installation comprises a mixer box for mixing fresh air coming from said fresh air suction channel with carrier-air mixture coming from said single manifold and therefore from the discharge channels of the preceding installations, a computerized continual analyzer for detecting the carrier concentration in the mixture formed in said mixer box, and a motor means connected to said analyzer and to said mixer box for controlling said mixer box in consideration of the results of the analysis performed by said analyzer.

In this way, by using a single manifold both for receiving the mixtures coming from the discharge channels of the installations and for supplying air to the intake channels of the installations, each user installation which operates in favorable conditions because it is charged to evaporate reduced quantities of carrier may use, as supplied air, air which is already mixed with some carrier, coming from preceding installations.

Each singular user installation receives air from the single manifold and takes advantage of the heat contained in the mixtures discharged by the preceding installations, thus improving the efficiency, and it operates with the maximum allowable value of the carrier concentration, even when the carrier quantity to be evaporated in the installation is very reduced. Moreover, each user installation receives air already mixed with carrier, whereby the quantity of fresh air introduced is reduced with respect to the known centralized systems and, correspondingly, is reduced the quantity of mixture discharged to the purifying system. The centralized device may be connected to user installations having requirements for mixture recirculation not compatible with the requirements of other installations, whereby the whole of the installations has a compact size and the building and management burdens are reduced.

BRIEF DESCRIPTION OF THE DRAWING

This invention will be further described with reference to an embodiment applied to rotogravure machines, however this specific example of application is to be regarded as a non-limiting example. The sole FIGURE of the appended drawing shows a simplified diagram of the ventilation circuit purporting to a single installation, and of the connection of this ventilation circuit to the single manifold of the centralized device. It is to be understood that the number of installations, and therefore of the ventilation circuits involved, may be whatever, whereby the shown diagram is to be considered as repeated for each installation connected to the centralized system.

DESCRIPTION OF THE PREFERRED EMBODIMENT

With reference to the drawing, therein are diagrammatically shown the main components of a ventilation circuit being the subject of the invention. In each installation there is a tunnel T for evaporation of the solvent, and this tunnel will not be described nor shown in detail, because the application of the invention does not require any modification thereof with respect to the known art. In tunnel T, a printed support S is caused to travel according to the arrow F in order that the carrier or solvent of the ink or lacquer applied to the printed support S be evaporated.

Number 1 designates a channel which receives an air-carrier mixture (coming from preceding installations) from the reception, delivery and discharge manifold 13 of the centralized device, which manifold, according to the main feature of the invention, is single. Number 2 designates a mixer box, wherein the air-carrier mixture received through channel 1 from manifold 13 is mixed with fresh air coming through a fresh air suction channel 0. Number 3 designates a channel supplying the mixture formed in the mixer box 2 to a supply fan 4 which forwards the same to a heat exchanger 5 in order to properly heat the air to be supplied to the installation.

On the supply channel 3 is branched a computerized continual analyzer 15, and a motor means 16 is connected to analyzer 15 and to box 2 in order to control said mixer box 2 in consideration of the results of the analysis performed by the analyzer 15, for maintaining in the mixture supplied to the channel 3 a proper ratio of air to carrier, suitable for the requirements of the installation. The whole of the components now described forms an air supply device.

Number 6 designates a channel of a discharge device, which is connected to the discharge channel of the installation and to the single manifold 13. The discharge device also comprises a computerized analyzer 7 intended to detect the concentration of carrier in the mixture coming from the discharge channel of the installation. A recirculation channel 8 is connected between the discharge channel 6 and the supply channel 3.

Number 9 designates a recirculation system consisting of three valves. A first valve is inserted in the supply channel 3, a second valve is inserted in the discharge channel 6, and a third valve is inserted in the recirculation channel 8. The control of these valves allows subdividing the mixture passing through the discharge channel 6 in a portion directed to the manifold 13 for being discharged and a portion directed through the recirculation channel 8 to fan 4 along with a portion of the mixture coming from the supply channel 3, as described in more detail later on. The valves of the recirculation system 9 are controlled by the analyzer 7 inserted on the discharge channel 6 in order to detect the carrier concentration in the mixture present in the discharge channel 6.

Moreover, two exclusion valves 10 and 11 are provided on the supply channel 3 and, respectively, on the discharge channel 6. These valves allow separating from the centralized device the installation when it is not in operation.

The system includes a discharge fan 12 situated at the end of the single reception, delivery and discharge manifold 13. The operation of the discharge fan 12 is controlled by a pressure detector 14 in order that, by modifying the rotational speed of fan 12, the depression in the reception, delivery and discharge manifold 13 is maintained constant.

Another computerized analyzer 17 may be inserted on the air supply channel 3 in order to detect and prevent excessive concentration of carrier in those cases in which the maximum carrier concentration takes place in the supply channel 3 and, therefore, upstream the recirculation system controlled by analyzer 7 which, in such cases, would not be able to correct such excessive concentration.

The operation of the described device is specified in the following. At the start of the operation, all elements of the rotogravure machine are in the following conditions:

1. The valves of the recirculation system 9 are positioned in such a way as to allow the maximum possible recirculation, thus optimizing the thermal balance and reducing to a minimum the quantity of discharged air.

2. The valves of the mixer box 2 are open towards the manifold 13 and are closed towards the fresh air suction channel 0, in order to introduce only the mixture coming from the manifold 13. Of course, this condition does not apply to the first element of the rotogravure machine, to which only fresh air may be directed.

The stated conditions are maintained until the analyzer 7 detects an excessive carrier concentration in the discharge channel 6. Then the analyzer 7 controls the valves of the recirculation system 9 in order to limit the recirculation, to add a larger quantity of mixture coming from the supply channel 3, and to discharge a corresponding quantity of mixture towards the manifold 13. In effect, the mixture quantity directed to the manifold 13 also comprises the so called "false air", namely an air quantity that penetrates from the ambient into the tunnel T, due to the fact that this latter is maintained in depression.

In the case that the mixture coming from the manifold 13, namely the mixture discharged from the preceding elements, already contains an excessive quantity of carrier, the value of the carrier concentration should be reduced below a preestablished limit. To this aim the valves of the supply box 2 are opened towards the fresh air suction channel 0 for introducing a suitable quantity of fresh air. Therefore the system may be programmed in such a way as to always maintain an allowable carrier concentration in the air directed to each machine element, the computerized analyzers correspondingly controlling both the valves of the recirculation system 8 and the valves of the supply box 2.

Thanks to the described features, the centralized device allows each machine element to use heated air (to the advantage of the total thermal balance of the machine) and air already mixed with carrier coming from the discharge of the preceding elements, the carrier concentration being reduced, if needed, by introduction of fresh air by action of the supply box.

The advantages of the application of a device according to the invention are numerous. Before all, the quantity of the discharged mixture is reduced to a minimum, and at the same time the concentration of carrier in the discharged mixture may be controlled at the maximum allowable by respecting the security regulations. As a direct consequence, the management burden of the carrier recuperation or destruction systems is reduced with respect to the known centralized recirculation systems. The recirculation in each machine element is entirely independent from the recirculation in the other machine elements. Therefore the system enjoys the advantages of the singular recirculation systems, wherein each machine element is provided with its own independent distribution, recirculation and discharge system for the air and the air-carrier mixture, and also the advantages of a centralized recirculation system, wherein the different peculiarities of the mixtures discharged by the various user installations are averaged by the mutual mixing, the mixtures having a lower content of carrier being suitable for diluting the mixtures having a higher content of carrier, and vice versa.

The recirculation of air-carrier mixture may be regulated at the maximum value compatible with the operation and security requirements. Finally, all the stated features are obtained by advantageously operating onto an averaged mixture, though ensuring the possibility of providing in each installation the optimal local conditions, considering its particular operation requirements.

Of course, other accessory component parts may be added to the described device, and several modifications, as well as any replacement by technically equivalent means, may be brought to the described device.

The invention claimed is:

1. A centralized air distribution, recirculation and discharge device intended to serve a number of user installations each having an intake channel and a discharge channel, said centralized device comprising only one single manifold for the reception, delivery and discharge of air-carrier mixture from and to the installations and a discharge fan connected to said single manifold, the discharge fan is controlled by a pressure detector for maintaining a constant depression in the single manifold, said centralized device further comprising for each installation: a device for air supply connected to said single manifold and having a fresh air suction channel and an air supply channel, a supply fan connected to said air supply device, a heater connected to said supply fan, said intake channel of the installation being connected to said heater, a discharge device connected to said discharge channel of the installation, connected to said manifold and comprising a discharge channel, and a recirculation device comprising a recirculation channel connected to said air supply device and to said discharge device.

2. The centralized air distribution, recirculation and discharge device as set forth in claim 1, wherein said air supply device for each user installation comprises a mixer box for mixing fresh air coming from said fresh air suction channel with carrier-air mixture coming from said single manifold and therefore from the discharge channels of the preceding installations, a computerized continual analyzer for detecting the carrier concentration in the mixture formed in said mixer box, and a motor means connected to said analyzer and to said mixer box for controlling said mixer box in consideration of the results of the analysis performed by said analyzer.

3. The centralized air distribution, recirculation and discharge device as set forth in claim 1, wherein said discharge device for each user installation comprises a discharge channel, and a computerized analyzer for detecting the carrier concentration in the air-carrier mixture present in said discharge channel, said computerized analyzer controlling said recirculation device.

4. The centralized air distribution, recirculation and discharge device as set forth in claim 1, wherein said recirculation device for each user installation comprises three valves, namely a first valve inserted in said air supply channel of the air supply device, a second valve inserted in said discharge channel of the discharge device and a third valve inserted in said recirculation channel of the recirculation device.

5. The centralized air distribution, recirculation and discharge device as set forth in claim 1, further comprising, for each user installation, two exclusion valves inserted on said air supply channel of the air supply device and, respectively, on said discharge channel of the discharge device, these valves allowing the separation from the centralized device of a non-operating user installation.

6. The centralized air distribution, recirculation and discharge device as set forth in claim 1, wherein said pressure detector is inserted on said single reception, delivery and discharge manifold and controls said discharge fan, in order to modify the operation velocity of said discharge fan for maintaining the constant depression in said reception, delivery and discharge manifold.

7. The centralized air distribution, recirculation and discharge device as set forth in claim 1, further comprising a computerized continual analyzer inserted on said air supply channel in order to detect and prevent excessive carrier concentrations in the mixture present in said air supply channel.

8. The centralized air distribution, recirculation and discharge device as set forth in claim 1, wherein each user installation is connected to said single manifold for receiving carrier-air mixture therefrom, using the heat of the mixtures discharged by the preceding installations, and reducing the introduction of fresh air and therefore the quantity of air-carrier mixture to be discharged.

9. A centralized air distribution, recirculation and discharge device intended to serve a number of user installations each having an intake channel and a discharge channel, said centralized device comprising only one single manifold for the reception, delivery and discharge of air-carrier mixture from and to the installations and a discharge fan connected to said single manifold, the discharge fan is controlled by a pressure detector for maintaining a constant depression in the single manifold, said centralized device further comprising the following components provided for each installation: a device for air supply, connected to said single manifold and having a fresh air suction channel and an air supply channel, a supply fan connected to said air supply device, a heater connected to said supply fan, said intake channel of the installation being connected to said heater, a discharge device connected to said discharge channel of the installation, connected to said manifold and comprising a discharge channel, and a recirculation device comprising a recirculation channel connected to said air supply device and to said discharge device.

10. The centralized air distribution, recirculation and discharge device as set forth in claim 9, wherein said air supply device for each user installation comprises a mixer box for mixing fresh air coming from said fresh air suction channel with carrier-air mixture coming from said single manifold and therefore from the discharge channels of the preceding installations, a computerized continual analyzer for detecting the carrier concentration in the mixture formed in said mixer box, and a motor means connected to said analyzer and to said mixer box for controlling said mixer box in consideration of the results of the analysis performed by said analyzer.

11. The centralized air distribution, recirculation and discharge device as set forth in claim 9, wherein said discharge device for each user installation comprises a discharge channel, and a computerized analyzer for detecting the carrier concentration in the air-carrier mixture present in said discharge channel, said computerized analyzer controlling said recirculation device.

12. The centralized air distribution, recirculation and discharge device as set forth in claim 9, wherein said recirculation device for each user installation comprises three valves, namely a first valve inserted in said air supply channel of the air supply device, a second valve inserted in said discharge channel of the discharge device and a third valve inserted in said recirculation channel of the recirculation device.

13. The centralized air distribution, recirculation and discharge device as set forth in claim 9, further comprising, for each user installation, two exclusion valves inserted on said air supply channel of the air supply device and, respectively, on said discharge channel of the discharge device, these valves allowing the separation from the centralized device of a non-operating user installation.

14. The centralized air distribution, recirculation and discharge device as set forth in claim 9, wherein said pressure detector is inserted on said single reception, delivery and discharge manifold and controls said discharge fan, in order to modify the operation velocity of said discharge fan for maintaining the constant depression in said reception, delivery and discharge manifold.

15. The centralized air distribution, recirculation and discharge device as set forth in claim 9, further comprising a computerized continual analyzer inserted on said air supply channel in order to detect and prevent excessive carrier concentrations in the mixture present in said air supply channel.

16. The centralized air distribution, recirculation and discharge device as set forth in claim 9, wherein each user installation is connected to said single manifold for receiving carrier-air mixture therefrom, using the heat of the mixtures discharged by the preceding installations, and reducing the introduction of fresh air and therefore the quantity of air-carrier mixture to be discharged.

17. A centralized air distribution, recirculation and discharge device intended to serve a number of user installations each having an intake channel and a discharge channel, said centralized device comprising only one single manifold for the reception, delivery and discharge of air-carrier mixture from and to the installations and a discharge fan connected to said single manifold, the discharge fan is controlled by a pressure detector for maintaining a constant depression in the single manifold, said centralized device further comprising for each installation: a device for air supply connected to said single manifold and having a fresh air suction channel and an air supply channel, a supply fan connected to said air supply device, a heater connected to said supply fan, said intake channel of the installation being connected to said heater and fed with heated air provided by said heater, a discharge device connected to said discharge channel of the installation, connected to said manifold and comprising a discharge channel, and a recirculation device comprising a recirculation channel connected to said air supply device and to said discharge device.

* * * * *

UNITED STATES PATENT AND TRADEMARK OFFICE

CERTIFICATE OF CORRECTION

PATENT NO. : 7,582,008 B2
APPLICATION NO. : 10/756500
DATED : September 1, 2009
INVENTOR(S) : Renzo Melotti It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1391 days.

Signed and Sealed this

Fourteenth Day of September, 2010

David J. Kappos

David J. Kappos
*Director of the United States Patent and Trademark Office*